US006729307B2

(12) United States Patent
Dong

(10) Patent No.: US 6,729,307 B2
(45) Date of Patent: May 4, 2004

(54) BYPASS/LEAKAGE COOLING OF ELECTRIC PUMP

(75) Inventor: Mike Dong, Ann Arbor, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/157,680

(22) Filed: May 29, 2002

(65) Prior Publication Data

US 2003/0140900 A1 Jul. 31, 2003

Related U.S. Application Data

(60) Provisional application No. 60/352,434, filed on Jan. 28, 2002.

(51) Int. Cl.[7] ..... F02M 37/04

(52) U.S. Cl. ..... 123/509; 123/497

(58) Field of Search ..... 123/509, 497, 123/456; 417/366, 370, 423.12

(56) References Cited

U.S. PATENT DOCUMENTS

| | | | | |
|---|---|---|---|---|
| 3,126,030 A | | 3/1964 | Stoermer | |
| 3,921,390 A | | 11/1975 | Stoltman | |
| 3,957,025 A | | 5/1976 | Heath et al. | |
| 4,160,629 A | | 7/1979 | Hidden et al. | |
| 4,304,526 A | | 12/1981 | Shetler, Sr. | |
| 4,370,966 A | | 2/1983 | Saruta et al. | |
| 4,407,642 A | | 10/1983 | Kemmner | |
| 4,421,087 A | | 12/1983 | Schuurman | |
| 4,499,885 A | | 2/1985 | Weissenbach, deceased et al. | |
| 4,501,253 A | | 2/1985 | Gerstmann et al. | |
| 4,679,539 A | | 7/1987 | Storbakken | |
| 4,718,827 A | * | 1/1988 | Sutton et al. | 417/244 |
| 4,816,045 A | | 3/1989 | Szlaga et al. | |
| 5,038,741 A | * | 8/1991 | Tuckey | 123/509 |
| 5,042,445 A | | 8/1991 | Peters et al. | |
| 5,050,567 A | * | 9/1991 | Suzuki | 123/514 |
| 5,070,849 A | * | 12/1991 | Rich et al. | 123/509 |
| RE35,079 E | | 11/1995 | Sverdlin | |
| 5,490,379 A | | 2/1996 | Wernberg et al. | |

(List continued on next page.)

FOREIGN PATENT DOCUMENTS

| | | | |
|---|---|---|---|
| EP | 0 643 219 A1 | | 3/1995 |
| EP | 0 819 852 A2 A3 | | 1/1998 |
| EP | 0 784 749 B1 | | 1/1999 |
| EP | 0 575 939 B1 | | 9/1999 |
| EP | 1 101 940 A2 | | 5/2001 |
| GB | 834689 | | 11/1960 |
| JP | 22610093 | * | 9/1993 |
| JP | 22610193 | * | 9/1993 |
| JP | 22610393 | * | 9/1993 |
| WO | WO 86/02141 | * | 4/1986 |
| WO | WO9318303 A | | 9/1993 |
| WO | WO 95/18297 | * | 7/1995 |
| WO | WO 96/10693 | * | 4/1996 |
| WO | WO 98/27330 | * | 6/1998 |
| WO | WO 98/44289 | * | 10/1998 |
| WO | WO 00/66487 | * | 11/2000 |

OTHER PUBLICATIONS

Derwent English Abstract for European patent application EP 0 784 749.*

Derwent English Abstract for PCT WO 95/18297.*

Derwent English Abstract for PCT WO 96/10693.*

*Primary Examiner*—Mahmoud Gimie

(74) *Attorney, Agent, or Firm*—Brinks Hofer Gilson & Lione

(57) ABSTRACT

An in-tank fuel pump for an automotive vehicle includes a pump housing having a pumping element, a low pressure inlet, and a high pressure outlet. A motor housing defining a motor cavity is mounted to the pump housing and a motor is mounted within the motor cavity in driving engagement with the pumping element. A bypass channel is adapted to allow a portion of the fuel flowing through the high pressure outlet to flow into the motor cavity.

22 Claims, 5 Drawing Sheets

U.S. PATENT DOCUMENTS 5,567,873 A 10/1996 Toyoda
5,596,970 A * 1/1997 Schoenberg et al. ..... 123/497
5,598,817 A 2/1997 Igarashi et al.
5,605,133 A 2/1997 Tuckey
5,647,328 A 7/1997 Fournier et al.
5,647,329 A 7/1997 Bucci et al.
5,673,670 A 10/1997 Powell et al.
5,682,845 A 11/1997 Woody
5,715,674 A 2/1998 Reuter et al.
5,727,529 A 3/1998 Tuckey
5,762,481 A * 6/1998 Oi ..... 417/423.3
5,908,286 A 6/1999 Clemmons
5,961,293 A * 10/1999 Clemmons et al. ..... 417/44.2
5,967,120 A 10/1999 Blanton et al.
5,979,485 A 11/1999 Tuckey et al.
6,131,552 A 10/2000 Paielli et al.
6,155,238 A 12/2000 Briggs et al.
6,158,975 A 12/2000 Dill et al.
6,167,703 B1 1/2001 Rumez et al.
6,220,217 B1 4/2001 Kato
6,279,541 B1 8/2001 Doane et al.
6,293,259 B1 9/2001 Kilgore et al.

* cited by examiner

BYPASS/LEAKAGE COOLING OF ELECTRIC PUMP

CROSS REFERENCE TO RELATED APPLICATIONS

This application claims the benefit of related provisional application Ser. No. 60/352,434 filed Jan. 28, 2002.

TECHNICAL FIELD

The present invention generally relates to a fuel pump for an internal combustion engine. More specifically, the present invention relates to a high pressure fuel pump cooled by bypass and leakage flows, either individually or in combination.

BACKGROUND

In low pressure applications, such as conventional port fuel injection gasoline engines on the order of 40–60 psi, fuel pumps typically route the fuel that is being pumped through the center of the pump motor to cool the motor and bearing of the pump. While this works very well at low pressures, direct injection engines require fuel to be delivered at higher pressures, on the order of 300 psi, as described in related provisional application Ser. No. 60/352,434, filed Jan. 28, 2002. The motor housing of a conventional high pressure fuel pump is not adapted to withstand the pressures produced by the high pressure fuel pump. Therefore, in a high pressure fuel pump, the fuel being delivered cannot be routed through the motor to provide cooling of the motor and the bearings. Therefore, there is a need for a high pressure fuel pump that provides a low pressure supply of fuel through the motor to cool the motor and bearings of the high pressure fuel pump.

DETAILED DESCRIPTION OF THE PREFERRED EMBODIMENTS

The following description of the preferred embodiments of the invention is not intended to limit the scope of the invention to these preferred embodiments, but rather to enable any person skilled in the art to make and use the invention.

Figure 1:
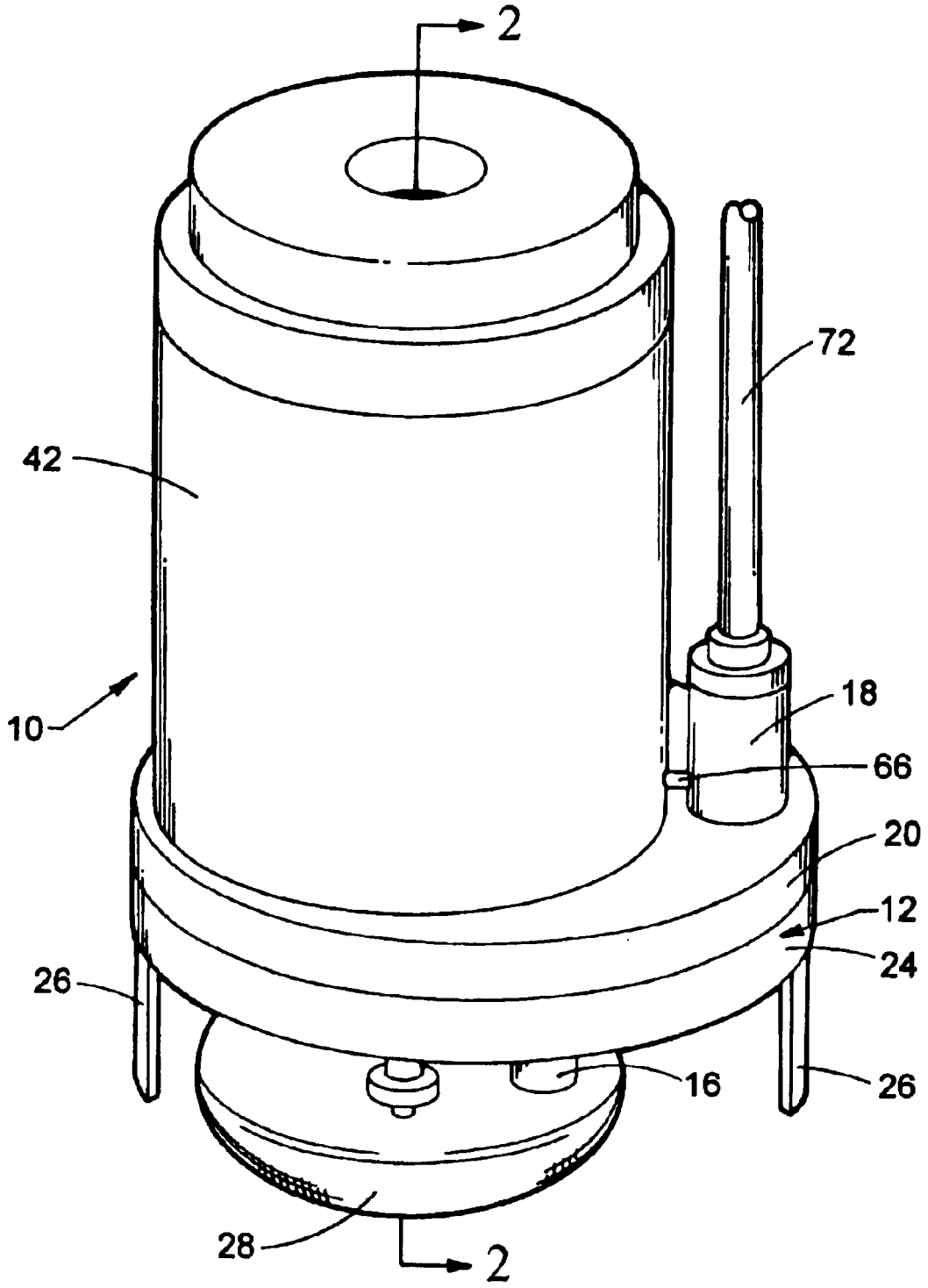
FIG. 1 is a perspective view of a first preferred embodiment.
Figure 2:
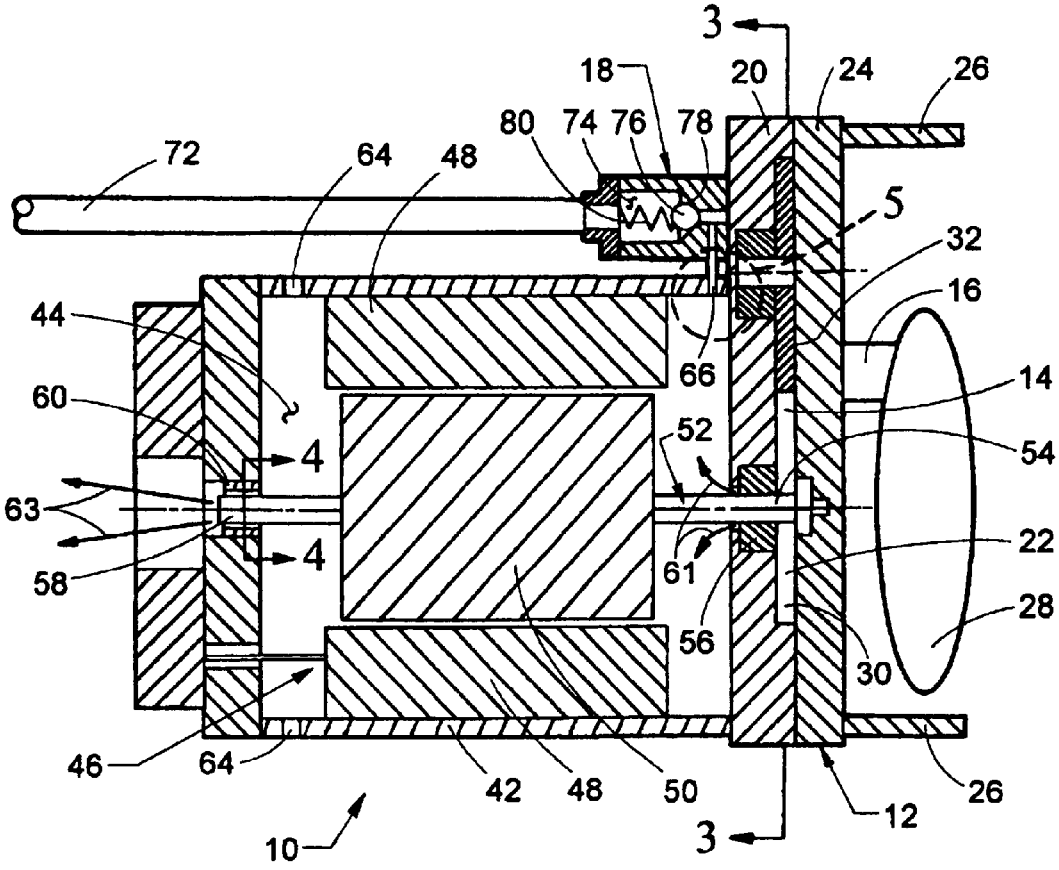
FIG. 2 is a sectional view taken along line 2—2 of FIG. 1.

Referring to FIGS. 1 and 2, an in-tank fuel pump for an automotive vehicle of a first preferred embodiment is shown generally at 10. The fuel pump includes a pump housing 12 having a pumping element 14 mounted therein. A low pressure inlet 16 allows fuel to enter the pump housing 12 and a high pressure outlet 18 allows fuel to exit the pump housing 12.

The pump housing 12 includes a base 20 having a pumping chamber 22 formed therein and a cover 24 mounted onto the base 20. The low pressure inlet 16 is formed within the cover 24 to allow fuel to be drawn from the fuel tank into the pumping chamber 22. The cover 24 further includes legs 26 extending downward to support the fuel pump 10 on the bottom of a fuel tank. Preferably, the low pressure inlet 16 of the fuel pump 10 is located near the bottom of the fuel tank to prevent air form being drawn into the fuel pump 10 when the level of fuel within the tank is low. A filter 28 is mounted onto the low pressure inlet 16 to filter the fuel that is drawn into the fuel pump 10.

Figure 3:
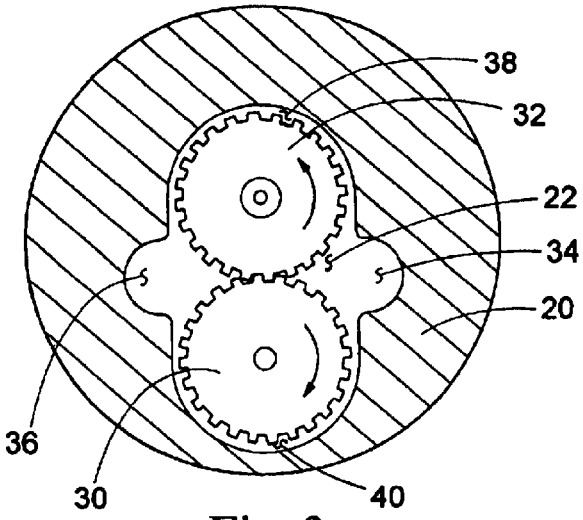
FIG. 3 is a sectional view taken along line 3—3 of FIG. 2.

Referring to FIG. 3, the pumping element 14 comprises a pair of intermeshing gears, a driving gear 30 and a driven gear 32, positioned within the pumping chamber 22. Both of the gears 30, 32 has a plurality of gear teeth, wherein the gear teeth of the driving gear 30 are intermeshed with the gear teeth of the driven gear 32. The driving gear 30 and the driven gear 32 fit within the pumping chamber 22 to define a low pressure cavity 34 in fluid communication with the low pressure inlet 16 and a high pressure cavity 36 in fluid communication with the high pressure outlet 18. Upon rotation of the gears 30, 32 within the pumping chamber 22, the gear teeth will draw fuel from the low pressure cavity 34, through the space between the individual teeth of the gears 30, 32, into the high pressure cavity 36 and to the high pressure outlet 18.

Referring again to FIGS. 1 and 2, a motor housing 42, defining a motor cavity 44, is mounted onto the pump housing 12, and a motor 46 is mounted within the motor cavity 44 to provide drive to the pumping element 14. Preferably, the motor 46 is an electric motor including a stator 48 mounted to the interior of the motor housing 42 and a rotor 50 rotatably supported within the stator 48. The motor 46 is preferably either a DC brush electric motor or a pulse width modulated brushless electric motor. The rotor 50 is supported by a shaft 52 extending therethrough. A first end 54 of the shaft 52 extends into the pump housing 12 and engages the driving gear 30 of the pumping element 14. The first end 54 of the shaft 52 is rotatably supported by a first bearing 56 mounted within the pump housing 12. A second end 58 of the shaft 52 is rotatably supported by a second bearing 60 mounted within the motor housing 42. The first and second bearings 56, 60 provide support for the shaft 52, and the rotor 50 is fixedly mounted onto the shaft 52 such that the rotor 50 is rotatably supported in functional engagement with the stator 48.

Figure 4:
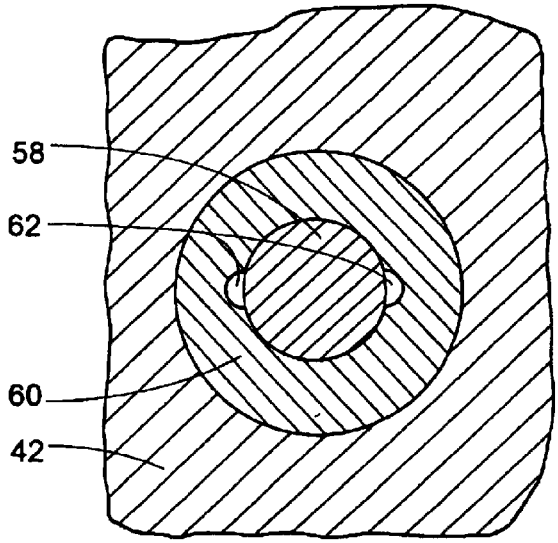
FIG. 4 is a sectional view taken along line 4—4 of FIG. 2.

Preferably, the dimensions of the first bearing 56 are such that fuel will leak from the pump housing 12 into the motor cavity 44, as indicated by arrows 61. Referring to FIG. 4, the second bearing 60 includes flow channels 62 extending therethrough. The flow channels 62 comprises channels formed within an inner diameter of the second bearing 60 which extends from the motor cavity 44 such that fuel can flow out from the motor cavity 44 through the flow channel 62, as indicated by arrows 63. The flow channels 62 can extend straight from the motor cavity 44 outward, or can spiral around the inner diameter of the second bearing 60. Spiraling flow channels 62 would act to draw the fuel from the motor cavity 44 as the second bearing 60 rotates.

Referring again to FIG. 2, the motor housing 42 can also include passages 64 formed near an end of the motor housing 42, distal from the first bearing 56, that will allow fuel within the motor cavity 44 to flow out of the motor cavity 44. When the pump 10 is operating, fuel flows into the motor cavity 44 around the first bearing 56, across the motor cavity 44 around the rotor 50 and stator 48 of the motor 46, and out of the motor cavity 44 through the flow channel 62 formed within the second bearing 60 and the passages 64 in the motor housing 42. This flow of fuel through the motor cavity 44 will provide cooling to the stator 48 and rotor 50, as well as providing lubrication to the first and second bearings 56, 60.

Figure 5:
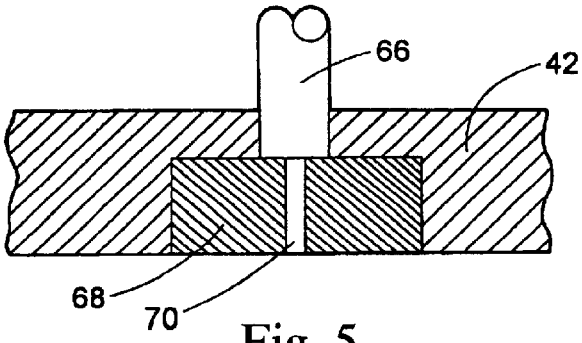
FIG. 5 is an enlarged view of a portion of FIG. 2.

Additionally, a bypass channel 66 allows a portion of the fuel flowing through the high pressure outlet 18 to flow into the motor cavity 44. The bypass channel 66 is defined by a small channel extending from the high pressure outlet 18, through the motor housing 42, and into the motor cavity 44. The bypass channel 66 provides another source of fuel flow into the motor cavity 44 along with the leakage from the first bearing 56. Referring to FIG. 5, preferably a nozzle 68 is positioned at the end of the bypass channel 66, immediately upstream of the motor cavity 44. The nozzle 68 includes a very small orifice 70 which restricts the amount of fuel flow through the bypass channel 66. The design of the nozzle 68 allows a sufficient amount of fuel to flow through the motor cavity 44 to provide cooling to the motor 46, while controlling the flow to maintain low pressure within the motor housing 42. Preferably, approximately 10–15% of the flow from the high pressure outlet 18 is diverted to the bypass channel 66.

The high pressure outlet 18 is connected to a fuel delivery pipe 72 adapted to be connected to the fuel rail of the vehicle. A check valve 74 positioned within the high pressure outlet 18 allows fuel to flow from the high pressure outlet 18 into the fuel delivery pipe 72, but prevents fuel from flowing back into the high pressure outlet 18 from the fuel delivery pipe 72. Preferably, the check valve 74 is a regulated one-way valve which allows fuel to flow out from the high pressure outlet 18 only when the fuel pressure within the high pressure outlet 18 exceeds a pre-determined level. This insures that the fuel being delivered to the fuel delivery pipe 72 is at the appropriate pressure, as required by the fuel injectors of the vehicle.

As shown, the check valve 74 is a biased ball type valve including a ball 76, a ball seat 78, and a biasing spring 80. The ball seat 78 faces away from the high pressure outlet 18 and the ball 76 is adapted to fit within the ball seat 78 such that when the pressure within the high pressure outlet 18 is lower than the pressure within the fuel delivery pipe 72, the ball 76 will be pushed against the ball seat 78 to substantially seal the check valve 74 to prevent fuel in the fuel delivery pipe 72 from flowing back into the high pressure outlet 18.

The biasing spring 80 provides additional force to maintain the ball 76 into the ball seat 78 when the pressure within the fuel delivery pipe 72 exceeds the pressure within the high pressure outlet 18. In order for the check valve 74 to open, the pressure within the high pressure outlet 18 must not only exceed the pressure in the fuel delivery pipe 72, but also the force of the biasing spring 80. In this way, the biasing spring 80 can be selected such that the check valve 74 will not open until the pressure within the high pressure outlet 18 exceeds a pre-determined amount. The check valve 74 could also be a spool valve, a diaphragm pressure regulator, or any other suitable valve which will restrict flow from the high pressure outlet 18 into the fuel delivery pipe 72 until the pressure within the high pressure outlet 18 exceeds a pre-determined amount.

Figure 6:
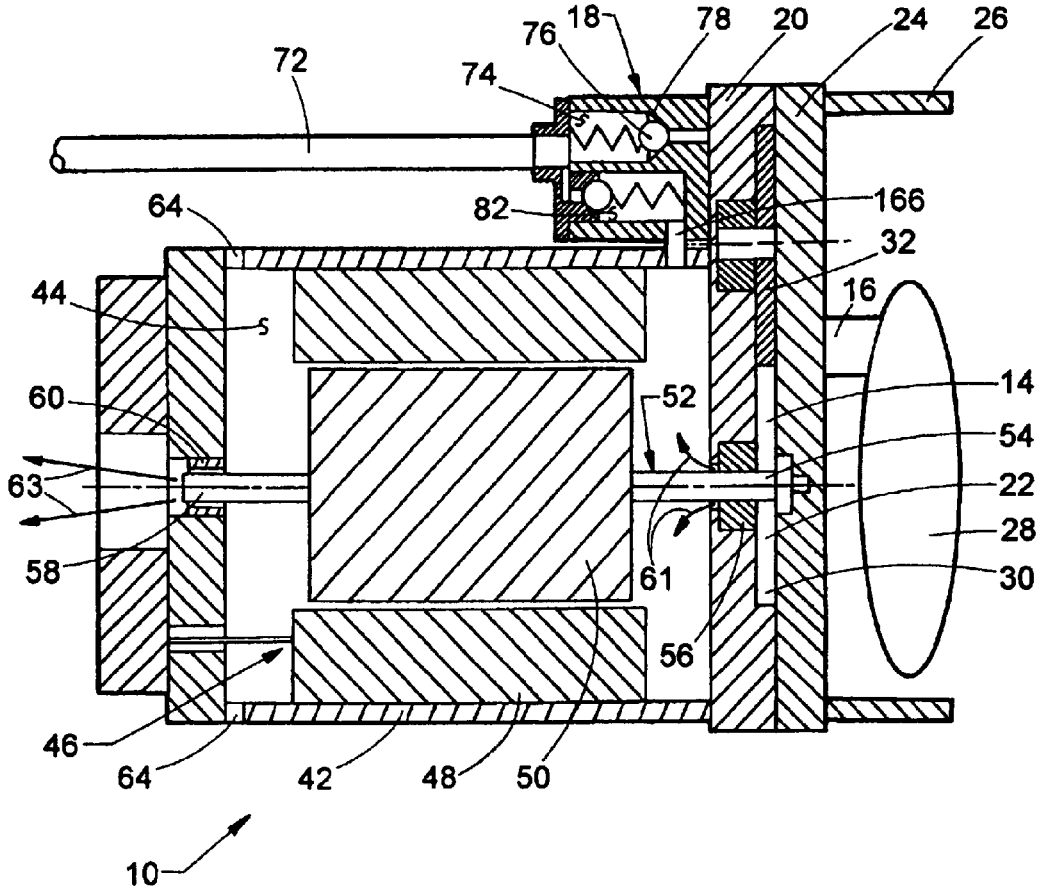
FIG. 6 is a sectional view similar to FIG. 2 of a second preferred embodiment.

In the first preferred embodiment, the bypass channel 66 extends from the high pressure outlet 18, upstream of the check valve 74, to the motor cavity 44, as shown in FIG. 2. Alternatively, a second preferred embodiment is shown in FIG. 6, wherein like components are numbered similarly to the first preferred embodiment of FIG. 2. A bypass channel 166 of the second preferred embodiment extends from the fuel delivery pipe 72, downstream of the check valve 74, to the motor cavity 44.

Further, the bypass channel 166 of the second preferred embodiment includes a relief valve 82 which is adapted to allow fuel to flow from the fuel delivery pipe 72 into the motor cavity 44, but prevents fuel from flowing back into the fuel delivery pipe 72 from the motor cavity 44. Preferably, the relief valve 82 is a regulated one-way valve, similar to the check valve 74, which is adapted to allow fuel to flow from the fuel delivery pipe 72 into the motor cavity 44 only when the fuel pressure within the fuel delivery pipe 72 exceeds a pre-determined level. The relief valve 82 can be a biased ball type valve like the check valve 74, or the relief valve 82 could be a spool valve, a diaphragm pressure regulator, or any other suitable valve which will restrict flow from the fuel delivery pipe 72 into the motor cavity 44 until the pressure within the fuel delivery pipe 72 exceeds a pre-determined amount.

Figure 7:
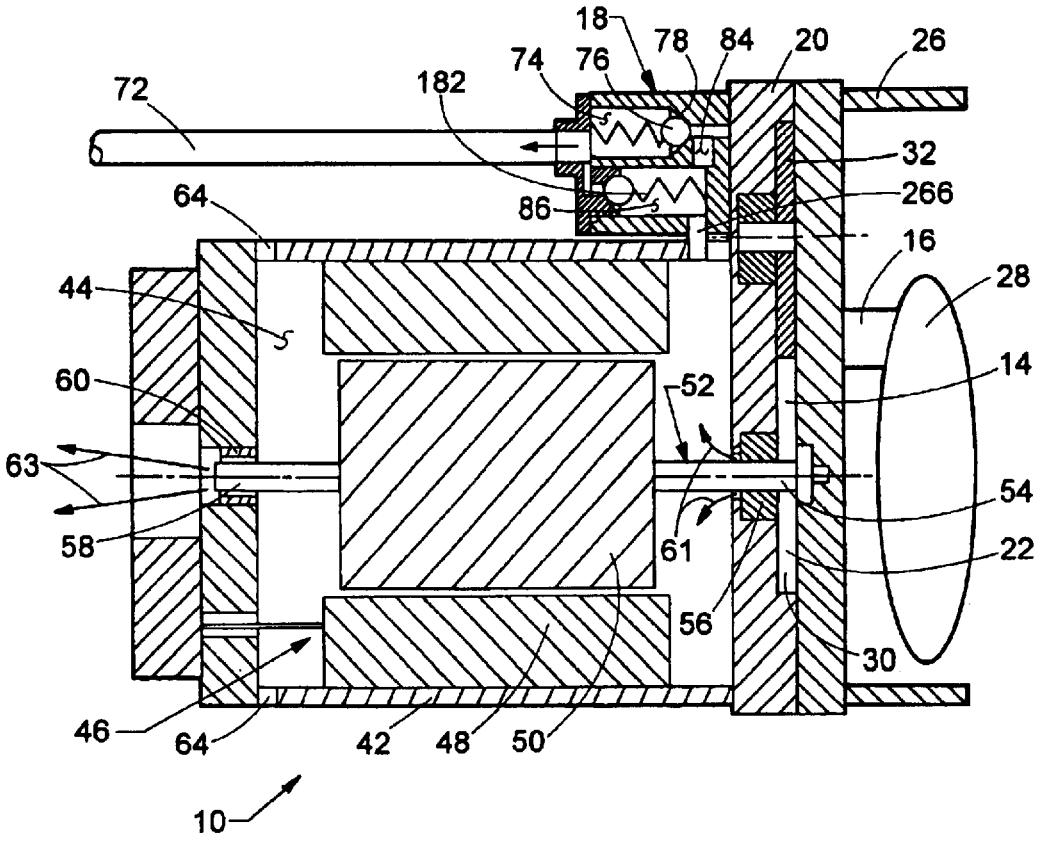
FIG. 7 is a sectional view similar to FIG. 2 of a third preferred embodiment.

Referring to FIG. 7, wherein like components are numbered similarly to the first and second preferred embodiments, in a third preferred embodiment a bypass channel 266 includes two branches. A first branch 84 extends from the high pressure outlet 18, upstream of the check valve 74, just as in the first preferred embodiment. A second branch 86 extends from the fuel delivery pipe 72, downstream of the check valve 74.

Further, the second branch 86 of the bypass channel 266 of the third preferred embodiment includes a relief valve 182 which is adapted to allow fuel to flow from the fuel delivery pipe 72 into the motor cavity 44, but prevents fuel from flowing back into the fuel delivery pipe 72 from the motor cavity 44. Preferably, the relief valve 182 is a regulated one-way valve, similar to the check valve 74, which is adapted to allow fuel to flow from the fuel delivery pipe 72 into the motor cavity 44 only when the fuel pressure within the fuel delivery pipe 72 exceeds a pre-determined level. Similarly to the first preferred embodiment shown in FIG. 5, preferably a nozzle 68 is positioned at the end of the bypass channel 266, immediately upstream of the motor cavity 44. This bypass provides fuel flow to the motor cavity 44 for cooling, while also providing a bleed back to keep the pressure within the fuel delivery pipe 72 from becoming too high when the fuel temperature rises. The relief valve 182 can be a biased ball type valve like the check valve 74, or the relief valve 182 could be a spool valve, a diaphragm pressure regulator, or any other suitable valve which will restrict flow from the fuel delivery pipe 72 into the motor cavity 44 until the pressure within the fuel delivery pipe 72 exceeds a pre-determined level.

The foregoing discussion discloses and describes three preferred embodiments. One skilled in the art will readily recognize from such discussion, and from the accompanying drawings and claims, that changes and modifications can be made to the preferred embodiments without departing from the true spirit and fair scope of the inventive concepts as defined in the following claims. The preferred embodiments have been described in an illustrative manner, and it is to be understood that the terminology which has been used is intended to be in the nature of words of description rather than of limitation.

What is claimed is:

1. An in-tank fuel pump for an automotive vehicle comprising:

a pump housing having a pumping element, a low pressure inlet and a high pressure outlet, said pumping element adapted to pump fuel from said low pressure inlet to said high pressure outlet;

a motor housing defining a motor cavity mounted to said pump housing;

a motor mounted within said motor cavity in driving engagement with said pumping element, said motor including a stator mounted within said motor cavity and a rotor rotatably mounted within said stator, said rotor including a motor shaft extending therethrough wherein a first end of said shaft is supported by a first bearing mounted within said pump housing and engages said pumping element and a second end of said shaft is rotatably supported by a second bearing mounted within said motor housing: and a bypass channel adapted to allow a portion of the fuel being pumped into said high pressure outlet to flow into said motor cavity;

said second bearing including a flow channel extending therethrough, said flow channel extending from said motor cavity to allow fuel to flow out from said motor cavity.

2. The fuel pump of claim 1 wherein said first bearing is adapted to allow leakage of fuel from said pump housing into said motor cavity.

3. The fuel pump of claim 1 further including passages formed within said motor housing adapted to allow fuel to flow out from said motor cavity.

4. The fuel pump of claim 1 including wherein said high pressure outlet is connected to a fuel delivery pipe which is adapted to be connected to the fuel rail of the vehicle.

5. The fuel pump of claim 4 wherein said high pressure outlet includes a check valve adapted to allow fuel to flow from said high pressure outlet into said fuel delivery pipe and to prevent fuel from flowing back into said high pressure outlet from said fuel delivery pipe.

6. The fuel pump of claim 5 wherein said check valve is a regulated one-way valve which is adapted to allow fuel to flow out from said high pressure outlet only when the fuel within said high pressure outlet exceeds a pre-determined level.

7. The fuel pump of claim 5 wherein said bypass channel extends from said high pressure outlet upstream of said check valve.

8. The fuel pump of claim 5 wherein said bypass channel extends from said fuel delivery pipe downstream of said check valve.

9. The fuel pump of claim 8 wherein said bypass channel includes a relief valve adapted to allow fuel to flow from said fuel delivery pipe into said motor cavity and to prevent fuel flow from said motor cavity into said fuel delivery pipe.

10. The fuel pump of claim 9 wherein said relief valve is a regulated one-way valve adapted to allow fuel to flow from said fuel delivery pipe into said motor cavity only when the fuel pressure within said fuel delivery pipe exceeds a pre-determined level.

11. The fuel pump of claim 5 claim wherein said bypass channel includes a first branch, extending from said high pressure outlet upstream of said check valve, and a second branch, extending from said fuel delivery pipe downstream of said check valve.

12. The fuel pump of claim 11 wherein said second branch includes a relief valve adapted to allow fuel to flow from said fuel delivery pipe into said motor cavity and to prevent fuel flow from said motor cavity into said fuel delivery pipe.

13. The fuel pump of claim 12 wherein said relief valve is a regulated one-way valve adapted to allow fuel to flow from said fuel delivery pipe into said motor cavity only when the fuel pressure within said fuel delivery pipe exceeds a pre-determined level.

14. The fuel pump of claim 1 wherein said bypass channel includes a nozzle adapted to restrict the flow of fuel through said bypass channel.

15. The fuel pump of claim 1 wherein a filter is connected to said low pressure inlet to filter fuel flowing into said pump housing.

16. The fuel pump of claim 1 wherein said pump housing includes a base having a pumping chamber formed therein and a cover mounted onto said base, and said pumping element comprises a driving gear and a driven gear, each having a plurality of gear teeth in meshing engagement with one another and being positioned within said pumping chamber.

17. The fuel pump of claim 16 wherein said driving gear and said driven gear fit within said pumping chamber to define a low pressure cavity in fluid communication with said low pressure inlet, a high pressure cavity in fluid communication with said high pressure outlet, wherein upon rotation of said driven gear by said shaft said gear teeth of said driving gear and said driven gear will draw fuel from said low pressure cavity, and into said high pressure cavity.

18. An in-tank fuel pump for an automotive vehicle comprising:

a pump housing having a pumping element, a low pressure inlet, and a high pressure outlet, said high pressure outlet being connected to a fuel delivery pipe which is adapted to be connected to the fuel rail of the vehicle, and said pumping element adapted to pump fuel from said low pressure inlet to said high pressure outlet;

a check valve mounted within said high pressure outlet adapted to allow fuel to flow from said high pressure outlet into said fuel delivery pipe and to prevent fuel from flowing back into said high pressure outlet from said fuel delivery pipe;

a motor housing defining a motor cavity mounted to said pump housing; and a bypass channel adapted to allow a portion of the fuel being pumped into said high pressure outlet to flow into said motor cavity, said bypass channel including a first branch extending from said high pressure outlet upstream of said check valve, and a second branch extending from said fuel delivery pipe downstream of said check valve.

19. The fuel pump of claim 18 wherein said second branch includes a relief valve adapted to allow fuel to flow from said fuel delivery pipe into said motor cavity and to prevent fuel flow from said motor cavity into said fuel delivery pipe.

20. The fuel pump of claim 19 wherein said relief valve is a regulated one-way valve adapted to allow fuel to flow from said fuel delivery pipe into said motor cavity only when the fuel pressure within said fuel delivery pipe exceeds a pre-determined level.

21. An in-tank fuel pump for an automotive vehicle comprising:

a pump housing, said pump housing including a base having a pumping chamber formed therein and a cover mounted onto said base;

a pumping element comprising a driving gear and a driven gear, each of said driving gear and said driven gear having a plurality of gear teeth in meshing engagement with one another and being positioned within said pumping chamber;

a low pressure inlet and a high pressure outlet, said pumping element adapted to pump fuel from said low pressure inlet to said high pressure outlet;

a motor housing defining a motor cavity mounted to said pump housing;

a bypass channel adapted to allow a portion of the fuel being pumped into said high pressure outlet to flow into said motor cavity.

22. The fuel pump of claim 21 wherein said driving gear and said driven gear fit within said pumping chamber to define a low pressure cavity in fluid communication with said low pressure inlet, a high pressure cavity in fluid communication with said high pressure outlet, wherein upon rotation of said driven gear by said shaft said gear teeth of said driving gear and said driven gear will draw fuel from said low pressure cavity, and into said high pressure cavity.

* * * * *

UNITED STATES PATENT AND TRADEMARK OFFICE

CERTIFICATE OF CORRECTION

PATENT NO. : 6,729,307 B2
DATED : May 4, 2004
INVENTOR(S) : Mike Dong

It is certified that error appears in the above-identified patent and that said Letters Patent is hereby corrected as shown below:

Column 5,
Line 59, after "claim 5" and before "wherein" delete "claim".

Signed and Sealed this

Twenty-first Day of September, 2004

JON W. DUDAS
*Director of the United States Patent and Trademark Office*